US009775388B2

(12) United States Patent
Czarnik

(10) Patent No.: US 9,775,388 B2
(45) **Date of Patent: *Oct. 3, 2017**

(54) COVER WITH CAPE FUNCTION

(71) Applicant: Super Blanky, LLC, Wixom, MI (US)

(72) Inventor: Karen Bonnici Czarnik, Wixom, MI (US)

(73) Assignee: Super Blanky, LLC, Wixom, MI (US)

( * ) Notice: Subject to any disclaimer, the term of this patent is extended or adjusted under 35 U.S.C. 154(b) by 1 day.

This patent is subject to a terminal disclaimer.

(21) Appl. No.: 14/834,731

(22) Filed: Aug. 25, 2015

(65) Prior Publication Data

US 2015/0359271 A1 Dec. 17, 2015

Related U.S. Application Data

(63) Continuation-in-part of application No. 14/087,021, filed on Nov. 22, 2013, now Pat. No. 9,155,341.

(60) Provisional application No. 61/734,576, filed on Dec. 7, 2012, provisional application No. 61/847,590, filed on Jul. 18, 2013.

(51) Int. Cl.

| | |
|---|---|
| ***A41D 15/00*** | (2006.01) |
| ***A41D 3/08*** | (2006.01) |
| ***A41D 15/04*** | (2006.01) |
| ***A47G 9/02*** | (2006.01) |
| ***A47G 9/06*** | (2006.01) |
| ***A41D 11/00*** | (2006.01) |
| *A41D 1/22* | (2006.01) |

(52) U.S. Cl.

CPC ..... *A41D 3/08* (2013.01); *A41D 11/00* (2013.01); *A41D 15/04* (2013.01); *A47G 9/0223* (2013.01); *A47G 9/064* (2013.01)

(58) Field of Classification Search

CPC .... A41D 15/00; A41D 11/00; A41D 2200/20; A41D 3/00; A41D 3/08; A47G 9/064; A47G 9/0223; A47G 9/1045; A63H 3/005; A41B 13/06; A45F 4/12

USPC ..... 2/69, 84, 88, 108, 243.1; D2/860, 861

See application file for complete search history.

(56) References Cited

U.S. PATENT DOCUMENTS

| | | | | |
|---|---|---|---|---|
| 4,316,288 | A * | 2/1982 | Henrickson | A41D 15/00 2/84 |
| D417,767 | S * | 12/1999 | Newhaller | D2/860 |
| 6,349,411 | B1 * | 2/2002 | Tyler | A41D 3/08 2/69 |
| D651,032 | S | 12/2011 | Adkins | |
| 8,225,422 | B1 | 7/2012 | McSparron | |
| 8,276,212 | B2 | 10/2012 | Quintanilla | |
| 9,155,341 | B2 * | 10/2015 | Czarnik | A41D 15/04 |

(Continued)

OTHER PUBLICATIONS http://www.amazon.com/Circo-Hooded-Towel-Pink/dp/B003IRO9WW.

(Continued)

*Primary Examiner* — Bobby Muromoto, Jr.

(74) *Attorney, Agent, or Firm* — Carlson, Gaskey & Olds, P.C.

(57) ABSTRACT

A convertible cover includes a cover and first and second nonrectangular panels. The first and second nonrectangular panels each have a generally horizontal set of opposing sides and a generally vertical set of opposing sides. The generally horizontal set of opposing sides is attached to the cover and the generally vertical set of opposing sides is not attached to the cover.

20 Claims, 7 Drawing Sheets

(56) References Cited

U.S. PATENT DOCUMENTS

| | | | | |
|---|---|---|---|---|
| 2008/0115254 | A1* | 5/2008 | Galkov | A41D 3/00 2/108 |
| 2008/0172788 | A1* | 7/2008 | Rosen | A47G 9/064 5/417 |
| 2009/0229031 | A1* | 9/2009 | Jackson | A47G 9/064 2/69 |
| 2010/0170039 | A1* | 7/2010 | Davis | A47D 15/006 5/494 |
| 2010/0205714 | A1* | 8/2010 | Pollack | A47G 9/066 2/69 |
| 2012/0276802 | A1* | 11/2012 | Anderman | A63H 3/003 446/27 |

OTHER PUBLICATIONS http://www.woombie.com/cuddle_cape.html.
https://www.cuddleuppets.com/.
http://happylittlemonkeystree.blogspot.com/p/blanket-capes.html.
http://www.kideapolis.com/CuddleCape.html.
http://www.littlegiraffe.com/catalog/categories/baby-love/towels/luxe-spo . . . .
http://www.target.com/c/blankets-throws-kids-bedding/-/N-5xtyf.

* cited by examiner

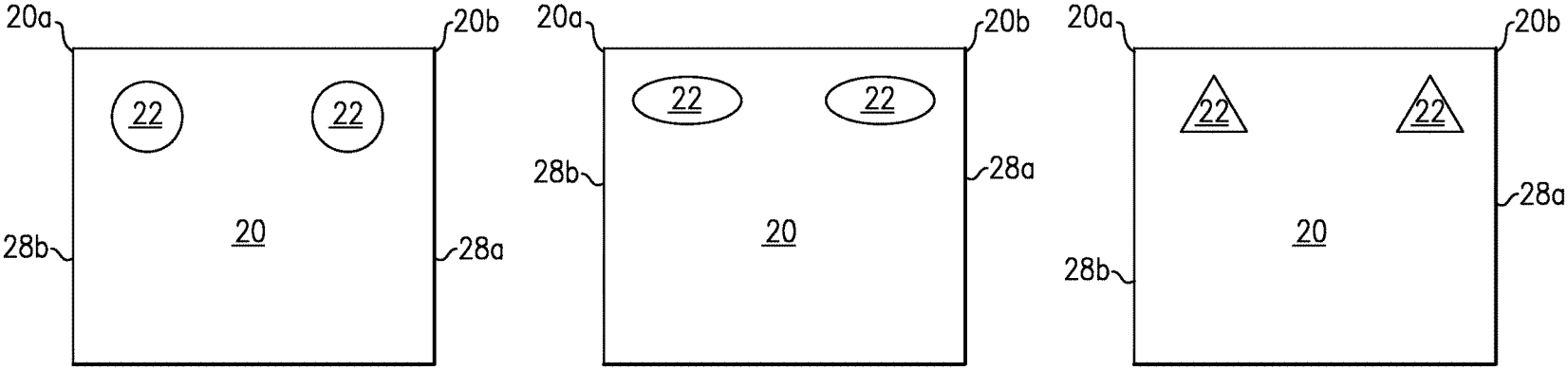
FIG.8a
FIG.8b
FIG.8c
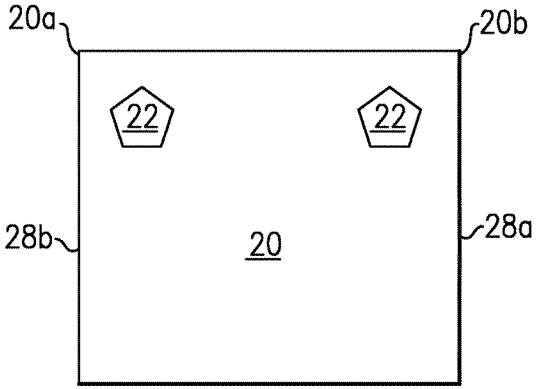
FIG.8d
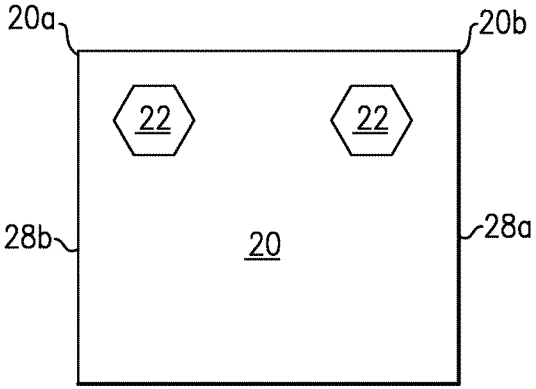
FIG.8e

COVER WITH CAPE FUNCTION

CROSS REFERENCE TO RELATED APPLICATIONS

This application is a continuation-in-part of U.S. patent application Ser. No. 14/087,021, filed Nov. 12, 2014, which claims priority to U.S. Provisional Application Ser. No. 61/734,576 filed Dec. 7, 2012, and U.S. Provisional Application Ser. No. 61/847,590, filed Jul. 18, 2013.

BACKGROUND

This application relates to a cover having sleeves that allow the cover to function as a cape.

Covers such as blankets or towels may be used in the conventional way, for example, for warmth, and may also be used as a cape by children or adults. In order to be used as a cape, the cover may include neckbands, zippers, snaps, buttons, or other fasteners to secure the cape. These fasteners may present a hindrance to the wearer by requiring extra steps to be performed in converting the cover into a cape, and may also be uncomfortable to the wearer.

SUMMARY

A convertible cover according to an example of the present disclosure includes a cover and first and second nonrectangular panels. The first and second nonrectangular panels each have a generally horizontal set of opposing sides and a generally vertical set of opposing sides. The generally horizontal set of opposing sides is attached to the cover and the generally vertical set of opposing sides is not attached to the cover.

An alternate convertible cover according to an example of the present disclosure includes a cover having a top edge and first and second side edges, a first nonrectangular sleeve in a first quadrant of the cover, and a second nonrectangular sleeve in a second quadrant of the cover adjacent to the first quadrant, a generally horizontal set of opposing sides and a generally vertical set of opposing sides. The generally horizontal set of opposing sides is attached to the cover and the generally vertical set of opposing sides is not attached to the cover.

A method of converting a blanket into a cape according to an example of the present disclosure includes providing first and second nonrectangular sleeves arranged in first and second corners of a blanket. Each of the sleeves has a generally horizontal set of opposing sides and a generally vertical set of opposing sides. The generally horizontal set of opposing sides is attached to the cover and the generally vertical set of opposing sides is not attached to the cover. The method also includes inserting first and second arms of a wearer completely through the first and second sleeves, respectively, and manoeuvring the first and second arms outward from the wearer such that the cover is extended into a cape via the sleeves.

BRIEF DESCRIPTION OF THE DRAWINGS

FIG. 8*a* schematically illustrates the cover of FIG. 2*a* with circular gauntlets.

FIG. 8*b* schematically illustrates the cover of FIG. 2*a* with oblong gauntlets.

FIG. 8*c* schematically illustrates the cover of FIG. 2*a* with triangular gauntlets.

FIG. 8*d* schematically illustrates the cover of FIG. 2*a* with pentagonal gauntlets.

FIG. 8*e* schematically illustrates the cover of FIG. 2*a* with hexagonal gauntlets.

DETAILED DESCRIPTION

Figure 1:
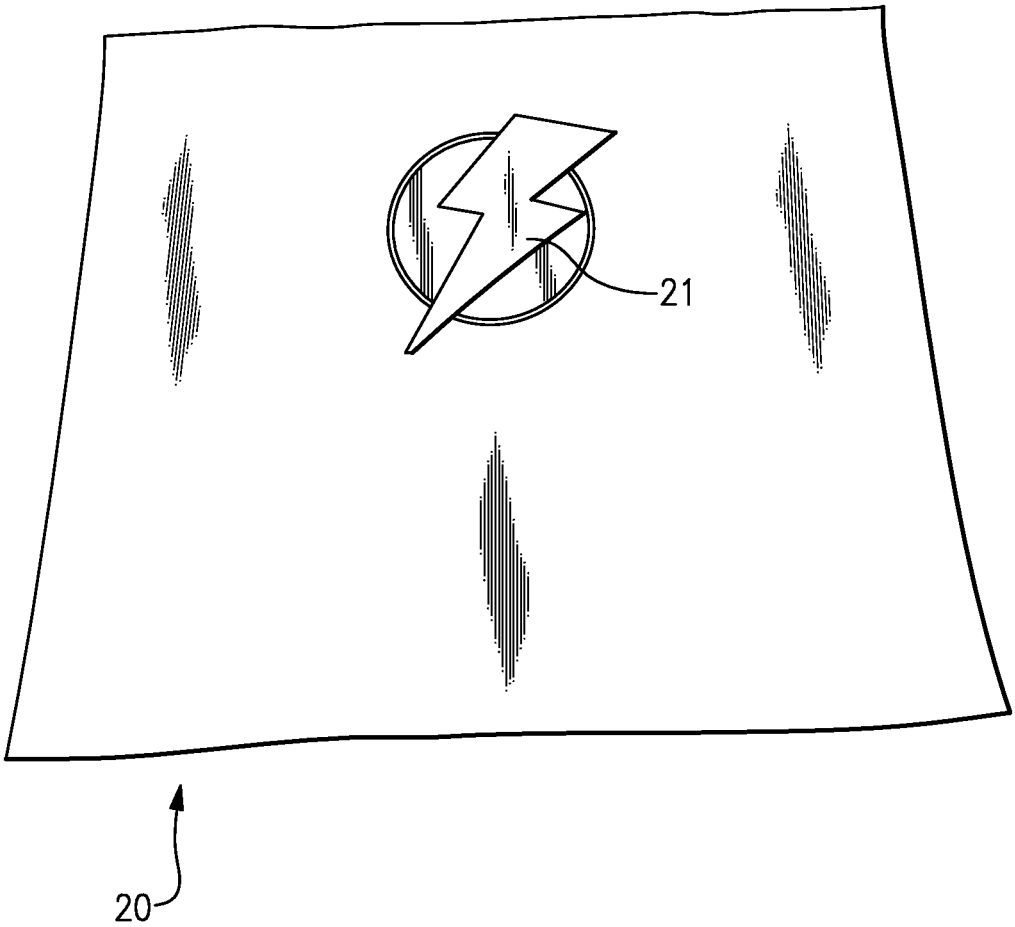
FIG. 1 illustrates a back side of a cover.
Figure 2A:
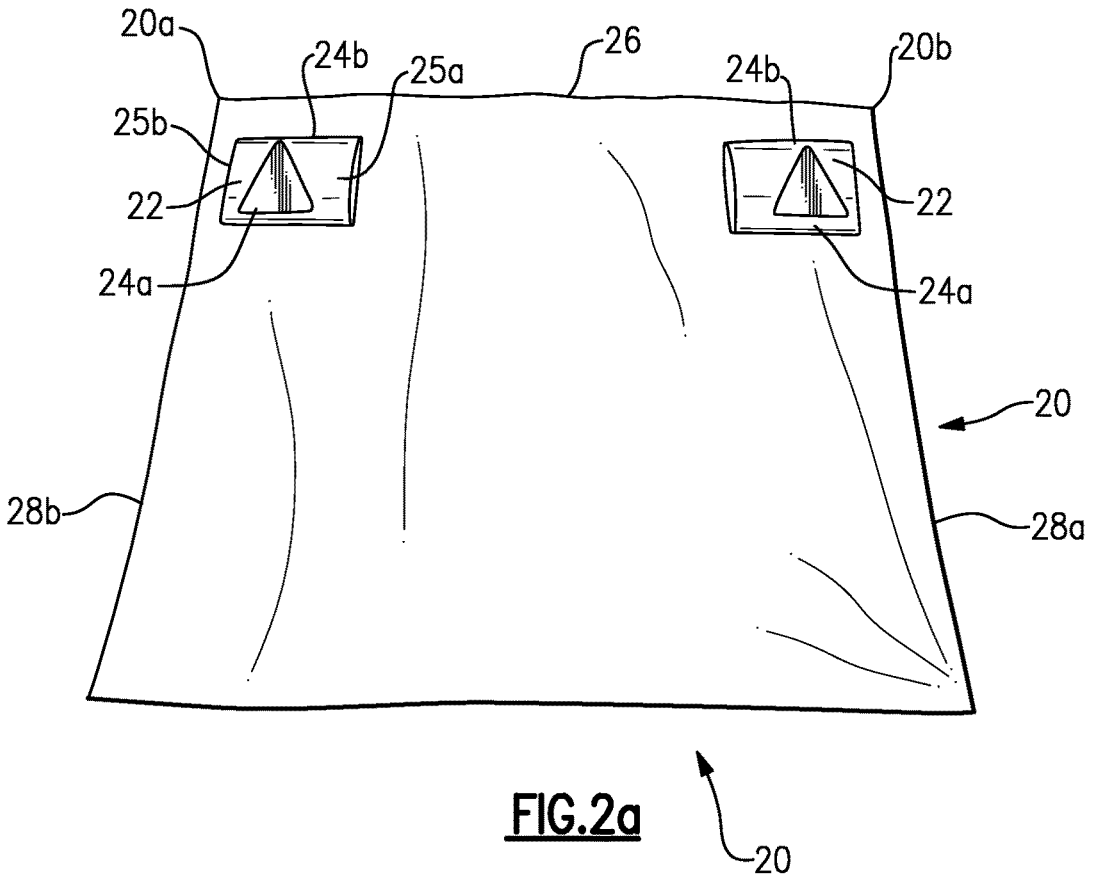
FIG. 2*a* illustrates a front side of the cover of FIG. 1, including sleeves.
Figure 2B:
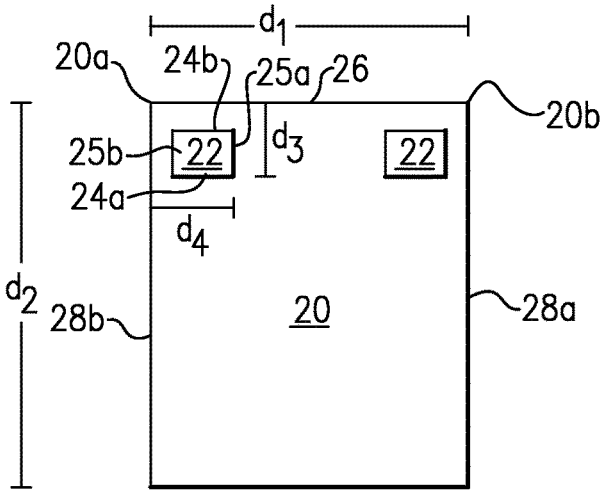
FIG. 2*b* schematically illustrates the cover of FIG. 2*a*, including dimensions of the cover.
Figure 3:
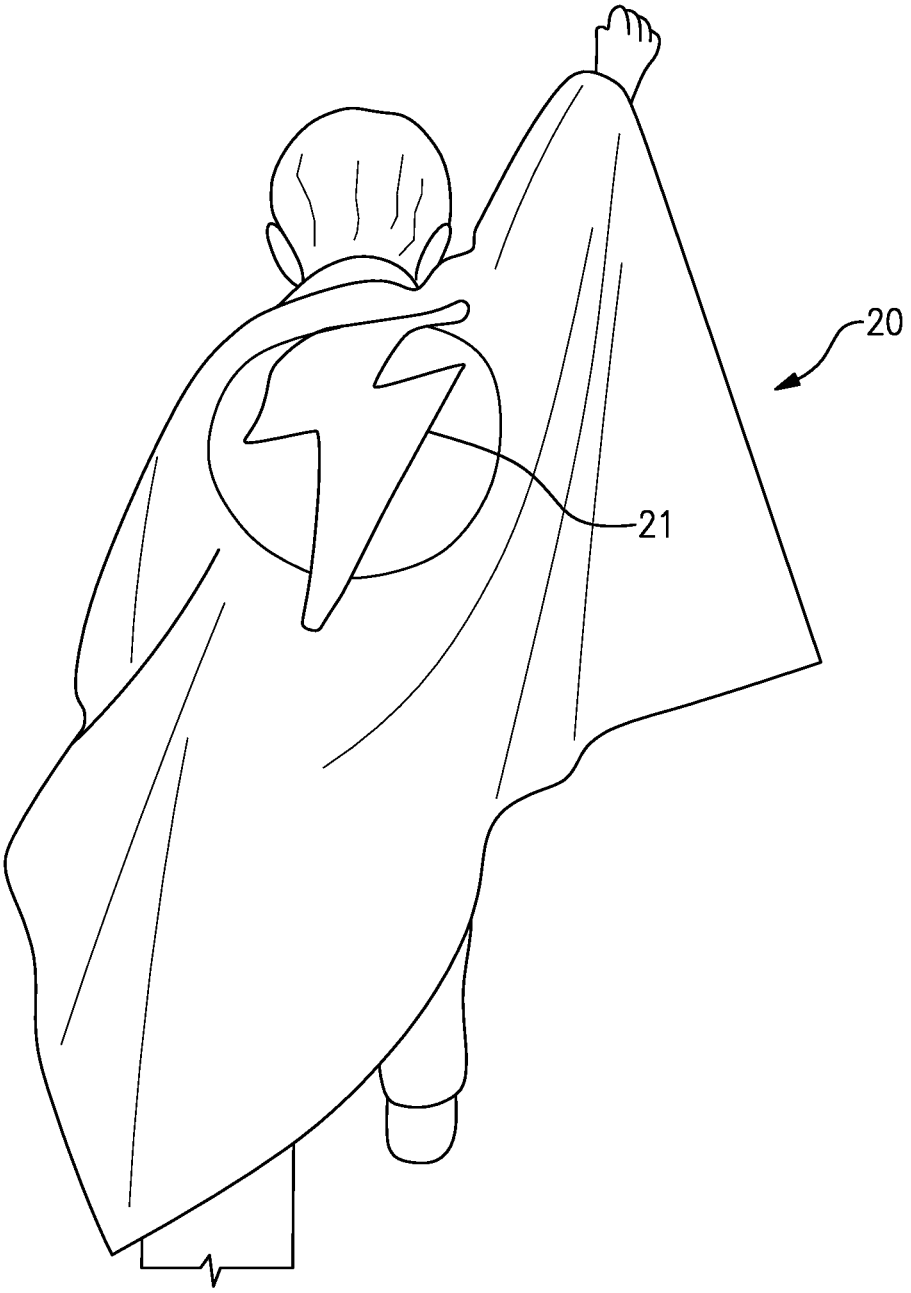
FIG. 3 illustrates a back view of a wearer wearing the cover of FIGS. 1-2*b* as a cape.
Figure 4:
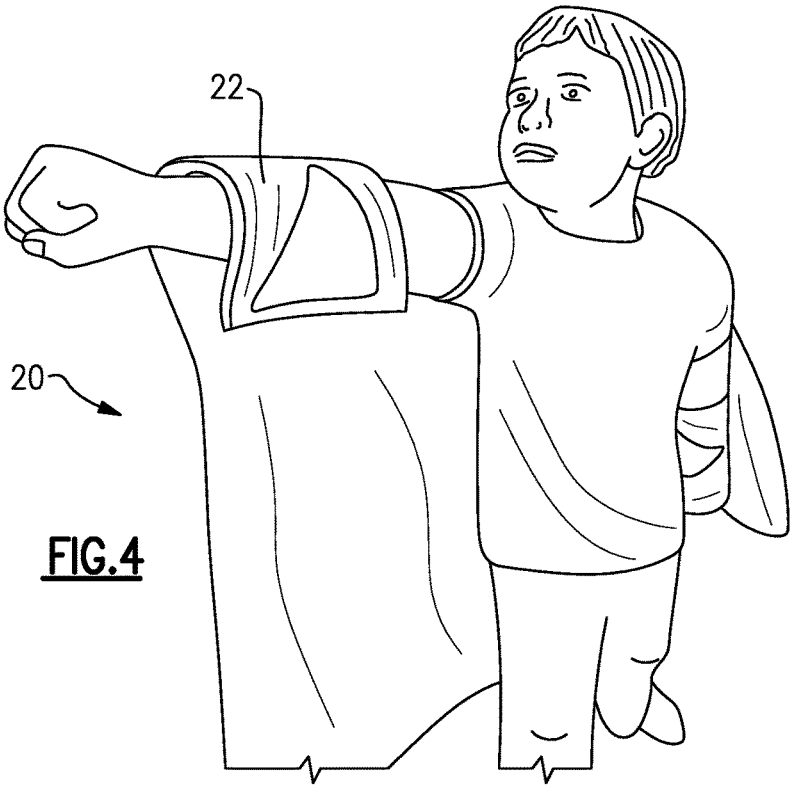
FIG. 4 illustrates a side view of the wearer wearing the cover of FIGS. 1-3 as a cape.
Figure 5:
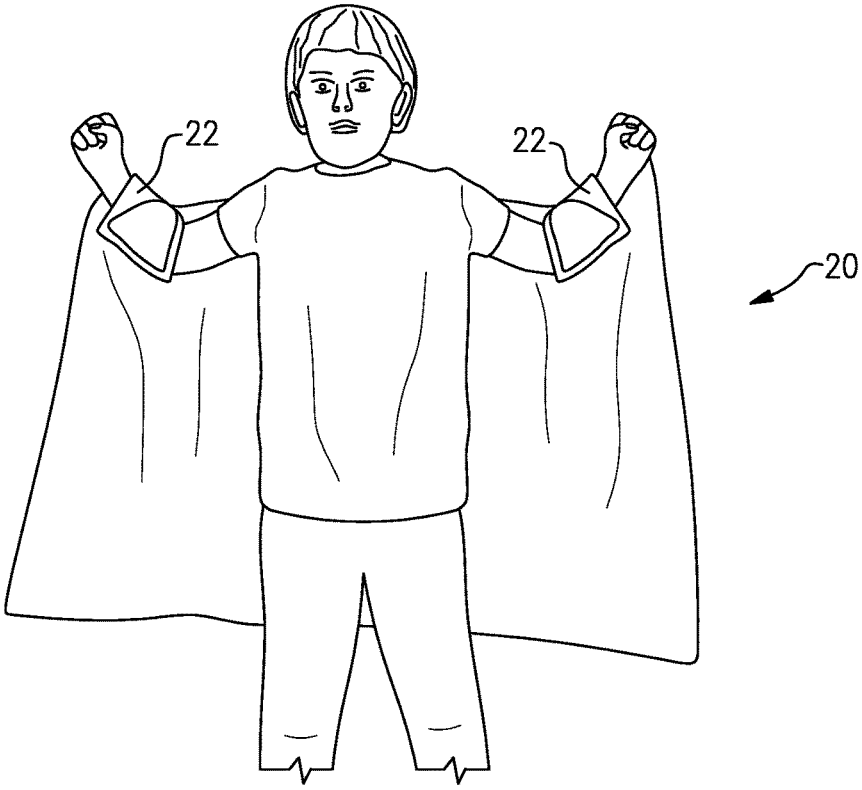
FIG. 5 illustrates a front view of the wearer wearing the cover of FIGS. 1-4.
Figure 6:
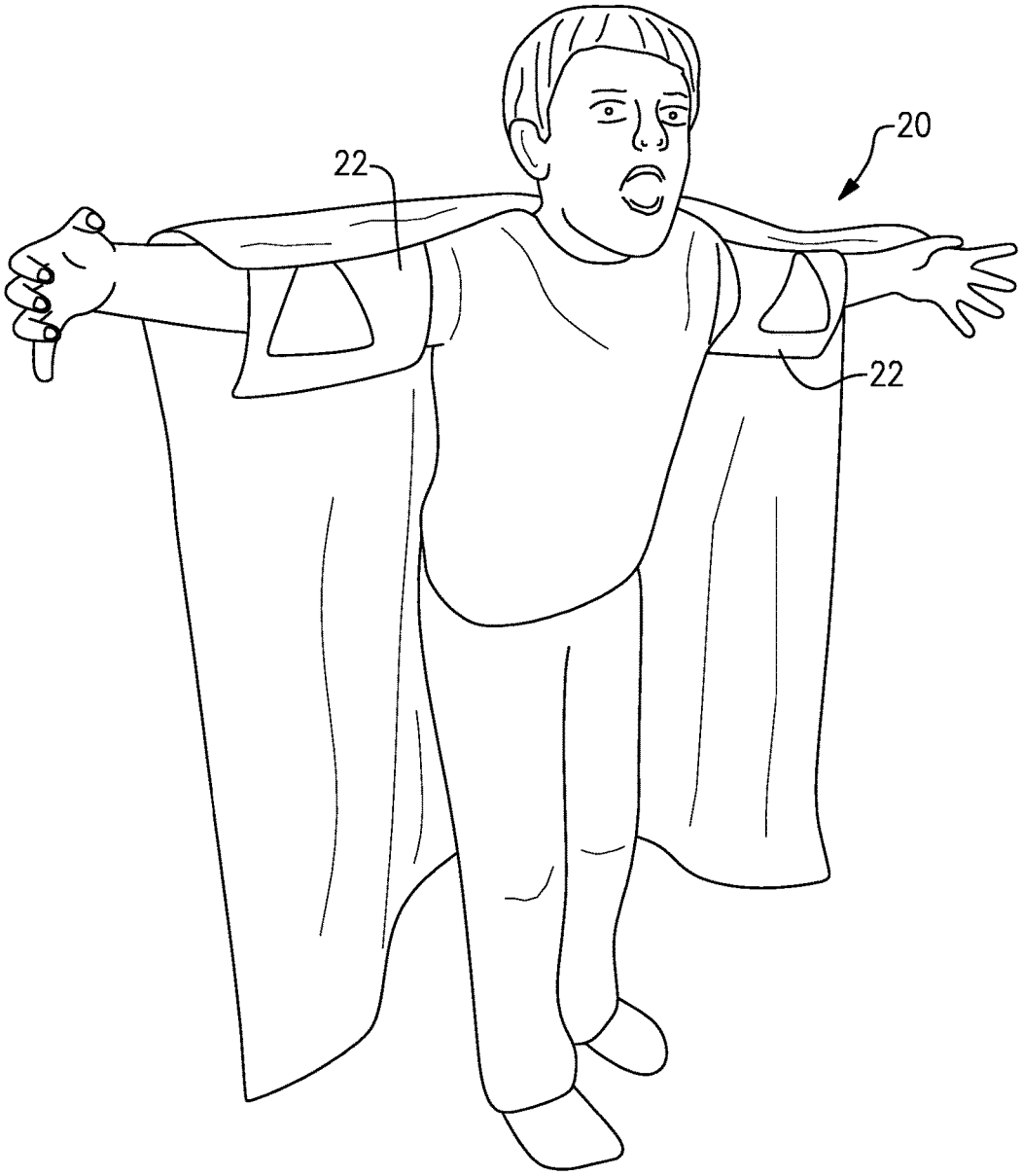
FIG. 6 illustrates an alternate front view of the wearer wearing the cover of FIGS. 1-5.

A cover 20 is illustrated in FIG. 1 and has gauntlets or sleeves 22 attached to one side of the cover 20, as shown in FIGS. 2*a*-*b*. The cover 20 can be, for example, a blanket or a towel. In the example of FIG. 1, the cover 20 is a blanket. The blanket 20 can alternate as a blanket for warmth or, when a wearer inserts his arms through the gauntlets 22, the blanket 20 functions like a cape, such as a superhero's cape as shown in FIGS. 3-6. The blanket 20 functions as a warm blanket but also wears as a cape without the hindrance of a neckband, zipper, snaps, buttons, etc. to secure the cape. In another example, the blanket 20 may be a towel and may be made of a terry cloth material.

When used for a child, the blanket may be approximately 40 inches by 47 inches although obviously other sizes can be utilized, for example, for children, adults, or dolls. A design 21 may be sewn on an opposed, or back, side of the blanket 20 from the gauntlets 22. The design 21 may vary, but in the illustrated embodiment, it is a superhero design. As examples, the design 21 could be angel's wings, bat wings, airplane wings, etc. The design 21 could also be team sports logos, animals, other licensed logos, custom & corporate designs, home décor or patterned fabrics, etc. The design 21 could also allow the blanket 20 to serve as a Halloween costume or may be another seasonal design. It should be understood that the design 21 illustrations provided herein are only exemplary and that other designs 21 may be used. In another example, the blanket 20 may not include the design 21 and may serve as a home fashion accessory.

The gauntlets 22 may be formed from panels attached to the interior, or front side, of the blanket 20. In the example shown in FIGS. 2*a*-6, the gauntlets 22 are rectangular and are attached to the blanket 20 at first and second opposing sides 24*a*, 24*b*. However, in another example, the gauntlets 22 may be another shape such as triangular, circular, octagonal, etc. Additionally, more than two gauntlets 22 may be attached to the blanket 20 at various positions to allow for rotation of the blanket 20 when converting the blanket 20 into a cape, which will be discussed in more detail below. For example, the gauntlets 22 may be sewn to the blanket 20 along the opposing sides 24*a*, 24*b*. It should be understood that the gauntlets 22 could vary from those in the Figures. As an example, it may be that the gauntlets 22 would be adjustable. The gauntlets 22 could be a panel sewn at one side 24*a*, with a Velcro® (Velcro Industries B.V., Amsterdam, the Netherlands) attachment, drawstring, elastic band, or another type of adjustable attachment, to the underlying blanket at the opposed side 24*b* such that the size can vary. In another example, the gauntlet 22 may be sewn to the blanket 20 at the side 24*b* and may be adjustably attached to the blanket 20 at the opposed side 24*a*. Alternatively, the gauntlets 22 could be formed of some form of elastic material, or a material with elastic bands at some location, such that the sides of the gauntlets 22 can vary.

The gauntlets 22 lay relatively flat against the blanket 20. The flat gauntlets 22 allow the blanket 20 to function as an ordinary blanket without any awkward interruptions or protrusions in the flow of the blanket 20 fabric. This allows the blanket 20 to be folded and/or lay flat as an ordinary blanket would.

Referring to FIGS. 2*a-b*, the gauntlets 22 may be attached to the blanket 20 at adjacent corners 20*a*, 20*b* of the blanket 20. The gauntlets 22 may be positioned about the periphery of the blanket 20 or closer to the center of the blanket 20. In one example, the gauntlets 20 may be positioned between 1 and 10 inches from either side of the blanket 20 which meet at the corners 20*a*, 20*b*. For example, the gauntlets 22 may be between 1 and 10 inches inward from the top edge 26 of the blanket 20 and between 1 and 10 inches inward from either of the side edges 28*a*, 28*b* of the blanket 20. As is shown in FIG. 2*b*, the top edge 26 of the blanket 20 may have a length $d_1$ and the side edges 28*a*, 28*b* may have a length $d_2$. The bottom edge 24*a* of the gauntlet 22 may be positioned a distance $d_3$ from the top edge 26 of the blanket 20. In one example, the ratio of the distances $d_3$:$d_2$ may be less than 0.5. More particularly, the ratio may be less than 0.4.

While the top and bottom edges 24*a*, 24*b* of the gauntlet 22 are shown parallel to the top edge 26, they need not be. Rather, they may merely extend along the top edge 26. The edges 25*a*, 25*b* of the gauntlet 22 are perpendicular to the edges 24*a*, 24*b*. The inner perpendicular edge 25*a* may be positioned a distance d4 from the side edge 28*b* of the blanket 20. In one example, the ratio of the distances $d_4$:$d_1$ may be less than 0.6. More particularly, the ratio of the distances $d_4$:$d_1$ may be less than 0.45. The ratio of the distances $d_3$:$d_2$ may be less than 0.5. More particularly, the ratio of the distances $d_4$:$d_1$ may be less than 0.4. In another example, the ratio of the distances $d_3$:$d_4$ may be between 0.3 and 2.0. More particularly, the ratio of the distances $d_3$:$d_4$ may be between 0.5 and 1.5. For instance, the positioning of the gauntlets 22 may be based on the size of the blanket 20. While the edges 25*a*, 25*b* are shown perpendicular to the top and bottom edges 24*a*, 24*b*, they need not be. Rather, they merely need to extend along the side edges 28*a*, 28*b*. The ratios $d_4$:$d_1$, $d_3$:$d_2$, and $d_3$:$d_4$ vary according to the size of a wearer of the blanket 20.

In use, the gauntlets 22 provide a sleeve for the wearer of the blanket 20. The backside of the sleeve is provided by the blanket 20 while the front side is provided by the gauntlet 22. In another example, the gauntlet may include an additional panel insert (not shown) attached to the blanket, such that either the backside or the front of the sleeve is provided by the additional panel insert. In the example shown in FIGS. 2*a-b*, the edges 24*a*, 24*b* of the gauntlet 22 which are attached to the blanket 20 are parallel to the top edge 26. The perpendicular edges 25*a*, 25*b* are not attached to the blanket 20, allowing the wearer to extend his or her arms completely through the sleeve for hands-free use of the blanket 20. When the wearer maneuvers his or her hands outward from his or her body, the blanket 20 edges extend outward and the blanket 20 acts as a cape.

In one embodiment, the gauntlets 22 are attached to the blanket 20 at the top and bottom edges 24*a*, 24*b*, but are spaced apart from the blanket. That is, the top and bottom edges 24*a*, 24*b*, are attached to the blanket 20 at attachments. A distance between the attachments is less than a distance between the top and bottom edges 24*a*, 24*b*, leaving a space, or "tunnel" between the gauntlets 22 and blanket 20. Still, the gauntlets 22 lay relatively flat against the blanket 20 such that the blanket 20 can be folded and/or lay flat as an ordinary blanket would.

In another example, the blanket 20 may additionally include a hood (not shown).

Figure 7B:
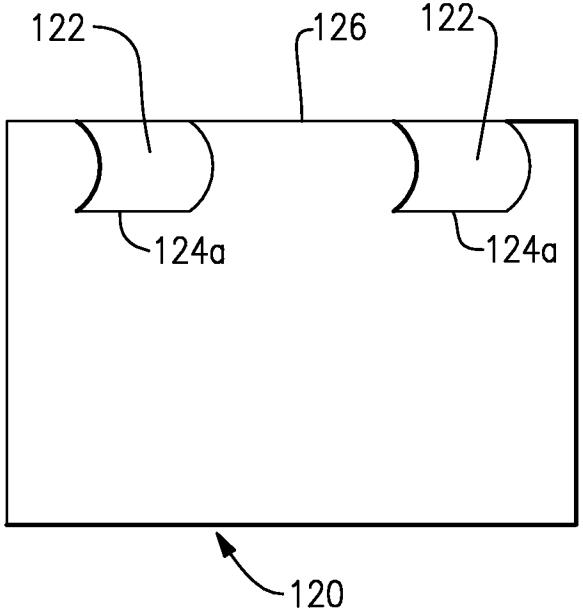
FIG. 7*b* illustrates an alternate cover in an attached position.
Figure 7A:
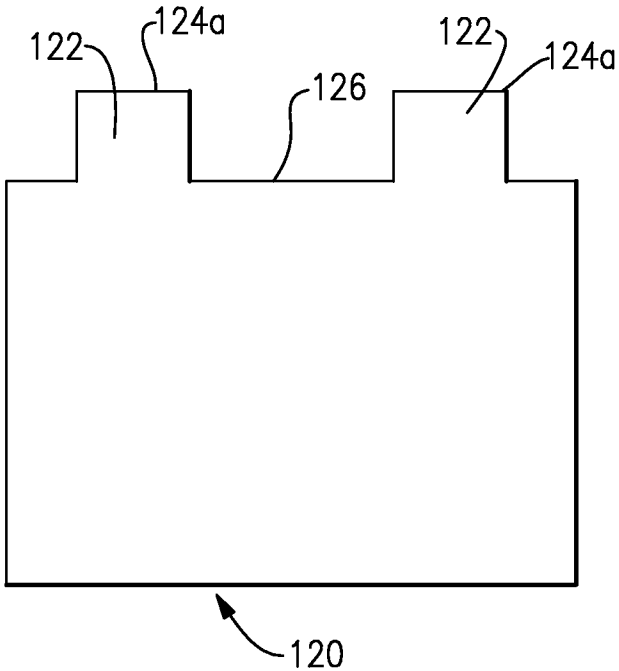
FIG. 7*a* illustrates an alternate cover in an unattached position.

FIGS. 7*a*-7*b* show an alternate example cover 120 where the gauntlets 122 are an integral part of the cover 120. As is shown in FIG. 7*a*, the gauntlets 122 are tabs extending from a top edge 126 of the cover 120. In FIG. 7*a*, the gauntlets are in an unattached position. The gauntlets 122 are shown as rectangular, but in another example, the gauntlets 122 can be another shape, such as triangular, circular, octagonal, etc. As is shown in FIG. 7*b*, the gauntlets 122 are in an attached position. The gauntlets 122 are folded down and attached to the cover 120 via a bottom edge 124*a* of the gauntlet 122, for example, by sewing.

Generally, the basic idea is the sleeve or gauntlets 22 provide the ability to attach a blanket 20 to the arms so it becomes a cape. This allows a "hands free" way of creating a cape from a blanket 20. Additionally, the blanket 20 is free from any potential choking hazards. When the wearer has his or her arms outstretched to turn the blanket 20 into a cape, he can simulate pretending to fly. Finally, the gauntlets 22 make it easy for a child to wrap himself in the blanket to wear it like a bathrobe or piece of clothing.

Although an embodiment of this disclosure has been explained, a worker of ordinary skill in this art would recognize that certain modifications would come within the spirit and scope of this invention. For example, one of ordinary skill will appreciate that various materials or fabrics can be used, such as fleece, quilt-like materials, materials with satin borders, etc. The materials can also be complex materials including multiple types of fabrics. Additionally, as is shown in FIGS. 8*a*-8*e*, respectively, nonrectangular (such as circular, oblong, triangular, pentagonal, hexagonal, etc.) shapes may be used for the cover 20, 120 or gauntlets 22, 122. The above description and the accompanying drawings should be interpreted as examples illustrating the inventive concept and shall not be construed as limiting the invention. For that reason, the following claims should be studied to determine the true scope and content of this invention.

The invention claimed is:

1. A convertible cover, comprising:

a cover; and first and second nonrectangular panels, the first and second nonrectangular panels each having a generally horizontal set of opposing sides and a generally vertical set of opposing sides, wherein the generally horizontal set of opposing sides is attached to the cover and the generally vertical set of opposing sides is not attached to the cover.

2. The convertible cover of claim 1, wherein the first and second panels are circular.

3. The convertible cover of claim 1, wherein the first and second panels are oblong.

4. The convertible cover of claim 1, wherein the first and second panels are triangular.

5. The convertible cover of claim 1, wherein the first and second panels are pentagonal.

6. The convertible cover of claim 1, wherein the first and second panels are hexagonal.

7. The convertible cover of claim 1, wherein the first and second panels provide first and second sleeves for a wearer, respectively.

8. The convertible cover of claim 3, wherein the cover provides a back side of the first and second sleeves and the first and second panels provide a front side of the first and second sleeves, respectively.

9. The convertible cover of claim 1, wherein the first and second panels are integral with the cover.

10. The convertible cover of claim 1, wherein the first set of opposing sides are attached to a front side of the cover via an adjustable attachment.

11. The convertible cover of claim 1, wherein the first and second panels lay relatively flat against the cover such that the cover can function as a blanket.

12. A convertible cover, comprising:

a cover having a top edge and first and second side edges;

a first nonrectangular sleeve in a first quadrant of the cover;

a second nonrectangular sleeve in a second quadrant of the cover adjacent to the first quadrant; and wherein each of the first and second nonrectangular sleeves each have a generally horizontal set of opposing sides and a generally vertical set of opposing sides, wherein the generally horizontal set of opposing sides is attached to the cover and the generally vertical set of opposing sides is not attached to the cover.

13. The convertible cover of claim 12, wherein the bottom edges of the first and second sleeves are each arranged a first distance from the top edge of the cover.

14. The convertible cover of claim 13, wherein a ratio of the first distance to a length of the first and second side edges of the cover is less than 0.5.

15. The convertible cover of claim 12, wherein the inner side edges of the first and second sleeves are arranged a second distance from the first and second side edges of the cover, respectively.

16. The convertible cover of claim 15, wherein a ratio of the second distance to a length of the top edge of the cover is less than 0.6.

17. The convertible cover of claim 15, wherein a ratio of the first distance to the second distance is between 0.3 and 2.0.

18. The convertible cover of claim 17, wherein the ratio of the first distance to the second distance is between 0.5 and 1.5.

19. A method of converting a blanket into a cape, comprising the steps of:

providing first and second nonrectangular sleeves arranged in first and second corners of a blanket, wherein each of the first and second nonrectangular sleeves each have a generally horizontal set of opposing sides and a generally vertical set of opposing sides, wherein the generally horizontal set of opposing sides is attached to the cover and the generally vertical set of opposing sides is not attached to the cover;

inserting first and second arms of a wearer completely through the first and second sleeves, respectively; and manoeuvring the first and second arms outward from the wearer such that the cover is extended into a cape via the sleeves.

20. The method of claim 19, further comprising the step of adjusting the size of the sleeves.

* * * * *